US006425243B1

(12) United States Patent
Chen et al.

(10) Patent No.: US 6,425,243 B1
(45) Date of Patent: Jul. 30, 2002

(54) HYBRID EXHAUST MANIFOLD FOR COMBUSTION ENGINES

(75) Inventors: Peter Yuan-Fun Chen, Ann Arbor; Michael Marvin Landgraf, Huntington Woods; Steven Henry Dropps, Milford, all of MI (US)

(73) Assignee: Ford Global Tech., Inc., Dearborn, MI (US)

( * ) Notice: Subject to any disclaimer, the term of this patent is extended or adjusted under 35 U.S.C. 154(b) by 0 days.

(21) Appl. No.: 09/307,862

(22) Filed: May 10, 1999

(51) Int. Cl.[7] ..... F01N 7/10

(52) U.S. Cl. ..... 60/323; 60/322; 60/313

(58) Field of Search ..... 60/323, 322, 313, 60/272, 282; 285/125.1, 424.1, 405; 29/890.052, 590.08, 525, 525.14

(56) References Cited

U.S. PATENT DOCUMENTS

| | | | | | |
|---|---|---|---|---|---|
| 4,500,030 | A | * | 2/1985 | Gerber et al. | 228/125 |
| 4,689,952 | A | * | 9/1987 | Arthur et al. | 60/313 |
| 4,784,615 | A | | 11/1988 | Teng-Hong | |
| 4,924,967 | A | | 5/1990 | Masahide et al. | |
| 4,930,817 | A | * | 6/1990 | Fuchs | 285/189 |
| 4,959,956 | A | * | 10/1990 | Yasuda | 60/323 |
| 5,018,661 | A | | 5/1991 | Cyb | |
| 5,144,800 | A | * | 9/1992 | Shioya et al. | 60/323 |
| 5,331,930 | A | * | 7/1994 | McWhorter | 123/79 R |
| 5,687,787 | A | * | 11/1997 | Atmur et al. | 164/98 |
| 5,706,655 | A | * | 1/1998 | Kojima et al. | 60/322 |
| 5,782,953 | A | | 7/1998 | Shah | |
| 5,784,882 | A | * | 7/1998 | Bonny et al. | 60/323 |
| 5,860,278 | A | * | 1/1999 | Rodenkrich | 60/313 |
| 5,888,641 | A | * | 3/1999 | Atmur et al. | 428/312.4 |
| 6,038,769 | A | * | 3/2000 | Bonny et al. | 29/890.08 |
| 6,082,104 | A | * | 7/2000 | Hyakutake et al. | 60/323 |

FOREIGN PATENT DOCUMENTS

| | | |
|---|---|---|
| EP | 0 321 869 A1 | 9/1989 |
| EP | 0 919 703 A2 | 10/1998 |
| GB | 1 375 496 | 11/1974 |
| JP | 3216261 A1 | 9/1991 |
| JP | 7233725 | 9/1995 |

* cited by examiner

*Primary Examiner*—Thomas Denion
*Assistant Examiner*—Binh Tran
(74) *Attorney, Agent, or Firm*—Ford Global Tech., Inc.

(57) ABSTRACT

An exhaust manifold 10 having a body 12 and a plurality of flanges 14–24. The body 12 is separately fabricated apart from flanges 14–24. The flanges 14–24 are later joined to the body and cooperatively form an exhaust manifold 10.

9 Claims, 1 Drawing Sheet

HYBRID EXHAUST MANIFOLD FOR COMBUSTION ENGINES

BACKGROUND OF THE INVENTION (1). Field of the Invention

This invention relates to an exhaust manifold for a combustion engine, and more particularly to an exhaust manifold for a combustion engine having a body and several flanges which are separately produced and/or formed and which are thereafter joined to the body and which cooperate with the body to form an exhaust manifold.

(2). Background

Exhaust manifolds are typically connected to the cylinder head or engine block of a combustion engine and receive and collect the various gases produced by the combustion process occurring within each of the engine's piston-containing chambers or cylinders. Particularly, the manifolds collect the exhaust gases and transfer the gases to an automobile exhaust system.

An engine may include several exhaust manifolds, each of which includes a generally hollow body typically having several integrally formed inlet flanges and one outlet flange. Each of the flanges surround an aperture, integrally formed within the body, which allows for communication with the interior of the hollow body.

Particularly, the inlet flanges are each adapted to be bolted upon the cylinder head or cylinder block and to be sealingly secured to a unique one of the cylinder chambers of the engine, thereby allowing the body apertures and the cylinders to cooperatively and sealingly communicate the waste gases into the interior of the manifold body. The sealing attachment of each of the manifold inlet flanges to the cylinder head is particularly important since a relatively large volume of relatively high temperature gasses typically pass through these manifolds and the emission of these untreated toxic gasses is environmentally undesirable. The unregulated flow of ambient air into the manifold is also undesirable. The outlet flange is also sealingly attached to the automobile exhaust system which normally includes the "downpipes," catalyst, muffler, and tailpipe. The outlet flange allows for the transfer of the collected waste gases, through a manifold body aperture, to the exhaust system. Because these manifolds collect and transmit relatively high temperature gas, they must have a considerable resistance against thermal stress fractures and fatigue; they must be structurally durable; and all of their sealing attachments must be and must remain very secure.

Usually these manifolds are created and/or formed as a "single integral piece" by the use of a relatively complex and relatively low yielding casting process which creates a relatively large amount of wasted material and which fails to produce the flange portions within certain desired tolerance limits, such as those associated with surface smoothness. Hence, once the manifolds are created, a separate "machining" or smoothing of each of the manifold flanges is required in order to ensure that the engine contacting surfaces of each of the flanges are relatively smooth and flat, thereby allowing for the secure formation of a sealing attachment of the flanges to the engine. Since the machining of these materials is difficult and time consuming, the overall cost of producing these manifolds is undesirably raised and the concomitant machining waste forms and/or represents undesirable and environmentally toxic waste products which must be eliminated and/or stored.

There is therefore a need to provide an exhaust manifold which is formed by a process which overcomes the various previously delineated drawbacks of the prior art; which reliably and sealingly communicates engine exhaust gases from the various cylinders of the automobile engine to the exhaust system; which has considerable resistance against thermal stress fractures and fatigue; and which requires minimal machining of the created manifold.

SUMMARY OF THE INVENTION

It is a first object of the invention to provide an exhaust manifold for a combustion engine which overcomes some or all of the previously delineated drawbacks of prior exhaust manifolds; which has considerable resistance against thermal stress fractures and fatigue; and which sealingly communicates with the cylinders and catalytic converter of a combustion engine.

It is a second object of the invention to provide an exhaust manifold for a combustion engine which includes separately fabricated portions which are later cooperatively joined to form an exhaust manifold.

It is a third object of the present invention to produce an exhaust manifold for a combustion engine which obviates the need to machine the is outlet and inlet flanges after the exhaust manifold is created or formed and which substantially minimizes the machining of the various other fittings and bosses which selectively allow for the flow of air into and out of the manifold.

According to a first aspect of the present invention, an exhaust manifold is provided. The exhaust manifold is made by the process of creating a body portion; creating a plurality of inlet flanges; creating an outlet flange; and joining the plurality of inlet flanges and the outlet flange to the body portion, thereby creating an exhaust manifold.

According to a second aspect of the present invention, a method to create an exhaust manifold is provided. The method includes the steps of forming a body portion of the exhaust manifold; forming at least one inlet flange; forming at least one outlet flange; forming a fitting assembly: and joining the at least one inlet flange, the fitting assembly, and the at least one outlet flange to the body portion, thereby forming an exhaust manifold.

According to a third aspect of the present invention, an automotive component is provided. The automotive component includes a first portion which is created by a first forming process and a second portion created by a second forming process and selectively joined to the first portion.

These and other objects, aspects, features, and advantages of the present invention will become apparent from a consideration of the following specification and the attached drawings.

DETAILED DESCRIPTION OF THE PREFERRED EMBODIMENT OF THE INVENTION

Figure 1:
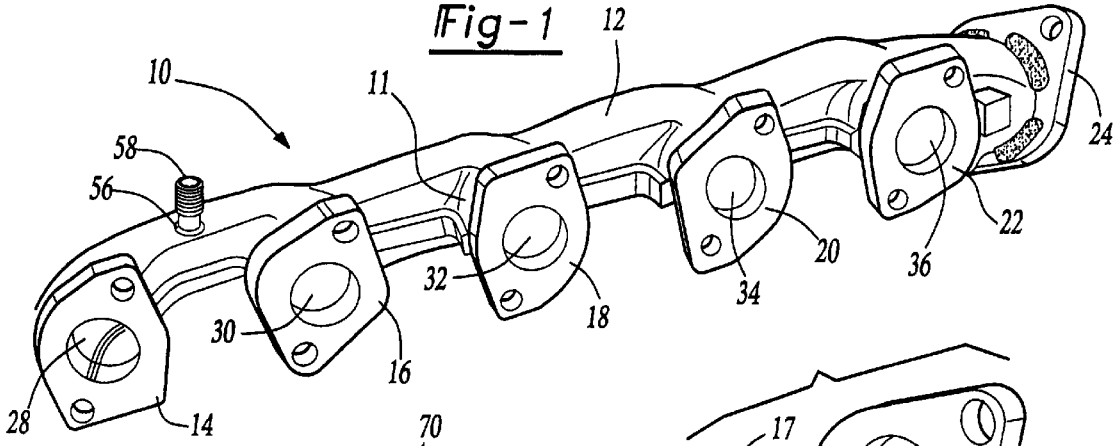
FIG. 1 is a perspective view of a hybrid exhaust manifold for a combustion engine made in accordance with the teachings of the preferred embodiment of the invention.
Figure 2:
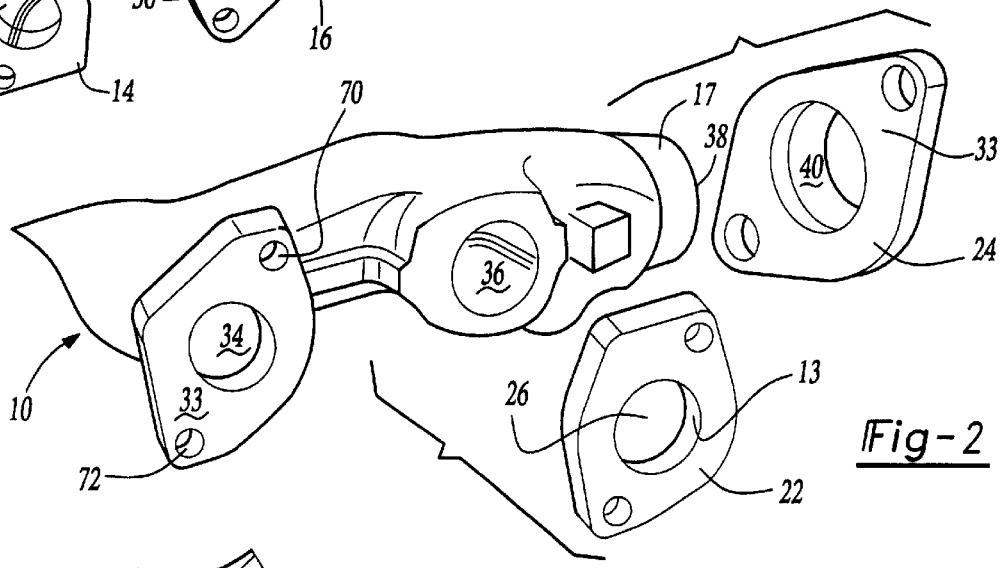
FIG. 2 is a perspective fragmented and unassembled view of the is hybrid exhaust manifold for a combustion engine made in accordance with the teachings of the preferred embodiment of the invention and shown in FIG. 1.
Figure 3:
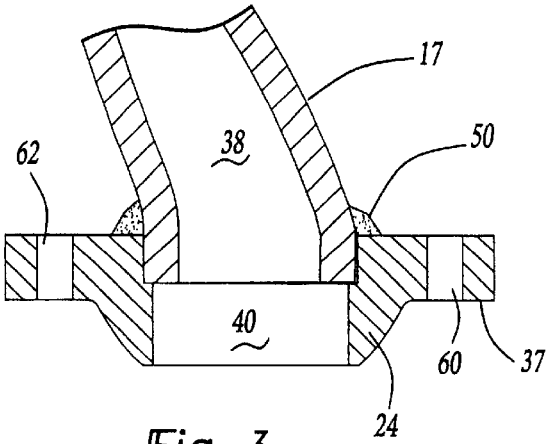
FIG. 3 is a cross sectional view of the outlet flange shown in FIG. 1.
Figure 5:
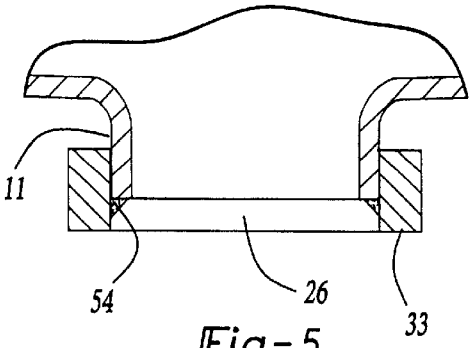
FIG. 5 is a cross sectional view of one of the inlet flanges shown in FIG. 1 according to an alternate embodiment of the invention.

Referring now to FIGS. 1–6, there is shown an exhaust manifold 10 made in accordance with the teachings of the preferred embodiment of the, invention. As shown, exhaust manifold 10 includes a generally hollow body 12 having integrally formed, substantially similar, outwardly extending inlet portions 11; and an outwardly extending outlet portion 17. Manifold 10 may also have a fitting assembly or "boss" reception aperture 64. Each portion 11 forms a unique one of the apertures 28, 30, 32, 34, 36 while portion 17 forms aperture 38. Apertures 28–38 and 64 allow for communication with the interior of body 12. In one embodiment, each of the apertures 28–36 are substantially identical.

Manifold 10 includes substantially identical inlet flanges 14, 16, 18, 20, 22 and an outlet flange 24, each of the flanges 14–22 having an aperture 26 which is substantially identical to a unique one of the apertures 28–36 while flange 24 has an aperture 40 which is substantially identical to aperture 38. Flanges 14–22 each have several substantially identical orifices 70, 72 which receive a bolt or another type of attachment member and which allow the flanges 14–22 to be tightly secured to the engine. Flange 24 also includes substantially identical orifices 60, 62 which similarly receive a bolt or another type of attachment member and which cooperatively allow flange 24 to be tightly secured to the automobile exhaust system. A fitting or "boss" 58 may be selectively received by aperture 64 and welded to the outside of body 12, thereby creating a welded connection 56. Particularly, fitting or boss 58 allows the connection of manifold 10 to a vented exhaust gas oxygen sensor; to a exhaust gas re-circulation assembly; and/or to an electric thermactor assembly which selectively and controllably injects ambient air into the exhaust stream for "feed gas treatment" purposes. Body 12 is fabricated separately and apart from the flanges 14–24 and boss 58, which are later joined to the body 12 in order to cooperatively form exhaust manifold 10. Particularly, body 12 is created by the use of a known and conventional casting process which utilizes conventional and commercially available stainless steel such as that described in the published specification number WSE-M1A329-A1 produced by Ford Motor Company. Alternatively, body 12 may be created by the use of other types of conventional and commercially available materials and by the use of other known stamping, forming, bending, or cutting processes. Inlet and outlet flanges 14–24 and boss 58 are separately formed and/or created, apart from the body 12, by known casting, stamping, and/or powder metal sintering processes and are formed from conventional and commercially available steel alloy materials or from the same material used in the formation of the body 12.

The separate fabrication of the flanges 14–24 and boss 58 allow for the creation of relatively smooth engine contacting surfaces 33, 37 and allows for the creation of flanges 14–24 and boss 58 having a desired size and shape and without the need to separately "machine" the flanges 14–24 or boss 58, after they are created, in order to correct for fabrication intolerances. The created exhaust manifold 10 has substantially the same strength; resistance to thermal cracking and fatigue; and durability as previously produced exhaust manifolds, but at a substantial reduction in production costs, After the body 12, flanges 14–24 and boss 58 are formed, each flange 14–22 frictionally receives a unique one of the portions 11, thereby allowing aperture 26 of each of the flanges 14–22 to communicate with a unique one of the body apertures 28–36 and to communicate with the interior of body 12. Flange 24 frictionally receives portion 17, thereby allowing aperture 40 to communicate with aperture 3 8 and with the interior of body 12.

Figure 4:
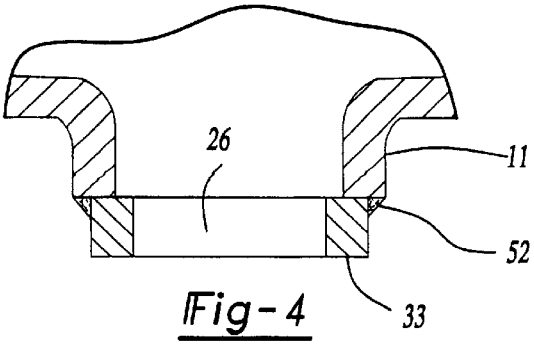
FIG. 4 is a cross sectional view of one of the inlet flanges shown in FIG. 1.
Figure 6:
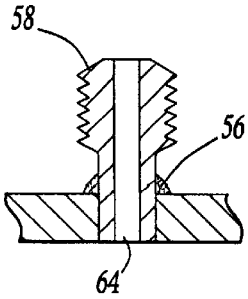
FIG. 6 is a cross sectional view of the manifold fitting assembly shown in FIG. 1.

As shown best in FIG. 4, each flange 14–22 is welded to a unique one of the portions 11 at surface portion 13, thereby producing a welded connection 54. Alternatively, as shown best in FIG. 5, flanges 14–22 do not frictionally fit upon body 12. Rather, each aperture 26 of each flange 14–22 is placed in a communicating relationship with a unique one of the apertures 287–36 and with the interior of body 12. Each flange 14–22 is held in place as it is welded to the outside portion of body 12, thereby producing a welded connection 52. As shown best in FIG. 3, flange 24 is welded and joined to the outer surface body 12, thereby producing a welded connection 50. Boss 58 is selectively welded to body 12 in the manner previously described.

Applicants's invention is not limited to the fabrication of a particular type of automotive component, nor is Applicants's invention limited to the exact exhaust manifold depicted within FIGS. 1–6. Rather, Applicants's invention may be applied to virtually any type of or shape of an exhaust manifold and allows for the independent and superior formation and fabrication of certain portions of an automotive component. Particularly, each portion is separately formed or created by a particular process which most economically and most efficiently creates that particular portion within certain desired tolerance limits. These portions, produced by different types of "hybrid" processes, are thereafter joined in a manner allowing for the cooperative formation of an overall automotive component or "part". Each portion of each component is therefore produced by a process which allows that portion to be produced at a relatively low cost while meeting certain technical parameters. Hence, the production cost of the overall component is reduced while maintaining certain technical standards of performance. The produced automotive component therefore utilizes the "best" features of each fabrication process and includes portions produced by a selected one of many potential fabrication processes. The selective fabrication of portions of an automotive component, each portion being produced by an "optimal" process, allows the overall component to be produced at a relatively low cost while meeting or exceeding certain technical requirements.

It is understood that the invention is not limited by the exact construction or method illustrated and described above but that various changes and/or modifications may be made withowt departing from the spirit and/or the scope of Aplicants's inventions.

What is claimed is:

1. An exhaust manifold comprising:

a one piece generally bollow body portion having a plurality of outwardly extending inlet portions and an outwarly extending outlet portion;

a plurality of inlet flanges, each having an inlet portion reception aperture and wherein a unique one of said plurality of inlet flanges is coupled to a unique one of said plurality of outwardly extending inlet portions; and an outlet flange which has an outlet portion reception aperture and is coupled to said outwardly extending outlet portion;

wherein said inlet portion reception apertures are formed to frictionally receive a unique one of said plurality of outwardly extending inlet portions and said outlet portion reception aperture is formed to fictionally receive said outwardly extending outlet portion.

2. The exhaust manifold of claim 1 wherein said body portion further includes a fitting assembly reception aperture.

3. The exhaust manifold of claim 2 wherein said exhaust manifold further comprises a fitting assembly which is received by and coupled to said fitting assembly reception aperture.

4. An exhaust manifold requiring no machining after assembly, said exhaust manifold comprising:

a generally hollow body portion having a plurality of integrally formed and outwardly extending cast inlet portions and an integrally formed and outwardly extending cast outlet portion, wherein said outwardly extending cast inlet portions and an integrally formed and outwardly extending cast outlet portion are not machined;

a plurality of inlet flanges, each having a relatively smooth engine contacting surface and a reception aperture that is formed to receive a unique one of said plurality of integrally formed cast inlet portions; and an outlet flange having a relatively smooth exhaust contacting surface and a reception aperture that is formed to frictionally receive said integrally formed cast outlet portion.

5. The exhaust manifold of claim 4 wherein said generally hollow body portion includes a fitting aperture which passes through said body into the generally hollow portion of said generally hollow body portion, said exhaust manifold farther comprising a afitting assembly which is selectively coupled to said fitting assembly aperture.

6. An exhaust manifold comprising:

a generally hollow body having a plurality of integrally formed and outwardly extending projecting numbers, wherein each of said integrally formed members includes an aperture extending therethrough which communicates with the interior of said generally hollow body; and a plurality of flange members having an aperture formed therethrough to frictionally receive a unique one of said integrally formed member, wherein each of said integrally formed members are sealingly and frictionally coupled to a unique one said plurality of flange members.

7. The exhaust manifold of claim 6 wherein said plurality of integrally formed members are not machined.

8. The exhaust manifold of claim 7 wherein said plurality of integrally formed members comprise a single exhaust outlet member and a plurality of exhaust inlet members.

9. The exhaust manifold of claim 8 wherein said generally hollow body further includes a boss aperture extending therethrough into the interior of said generally hollow body, said exhaust manifold further comprising a boss member which is disposed within and sealing coupled to said boss aperture.

* * * * *